US010701773B2

(12) United States Patent
Neumann

(10) Patent No.: US 10,701,773 B2
(45) Date of Patent: Jun. 30, 2020

(54) METHOD AND DEVICE FOR BRIGHTNESS COMPENSATION IN AN LED

(71) Applicant: Inova Semiconductors GmbH, München (DE)

(72) Inventor: Roland Neumann, München (DE)

(73) Assignee: Inova Semiconductors GmbH, München (DE)

( * ) Notice: Subject to any disclaimer, the term of this patent is extended or adjusted under 35 U.S.C. 154(b) by 0 days.

(21) Appl. No.: 16/079,933

(22) PCT Filed: Jan. 26, 2017

(86) PCT No.: PCT/EP2017/000092
§ 371 (c)(1),
(2) Date: Aug. 24, 2018

(87) PCT Pub. No.: WO2017/153026
PCT Pub. Date: Sep. 14, 2017

(65) Prior Publication Data

US 2019/0059137 A1 Feb. 21, 2019

(30) Foreign Application Priority Data

Mar. 10, 2016 (DE) ..... 10 2016 104 440

(51) Int. Cl.
*H05B 33/08* (2020.01)
*H05B 45/10* (2020.01)
*H05B 45/24* (2020.01)

(52) U.S. Cl.
CPC ..... *H05B 45/10* (2020.01); *H05B 45/24* (2020.01)

(58) Field of Classification Search
CPC ..... H05B 33/08; H05B 33/0845; H05B 33/0854; H05B 33/0866; H05B 33/0818;
(Continued)

(56) References Cited

U.S. PATENT DOCUMENTS

2008/0079371 A1 4/2008 Kang et al.
2008/0191631 A1 * 8/2008 Archenhold ..... H05B 33/0818 315/158
(Continued)

FOREIGN PATENT DOCUMENTS

EP 2141965 A1 1/2010
WO WO-2014067830 A1 * 5/2014 ..... H05B 33/0866
(Continued)

OTHER PUBLICATIONS

"International Application No. PCT/EP2017/000092, International Preliminary Report on Patentability dated Jun. 26, 2018", (Jun. 26, 2018), 17 pgs.
(Continued)

*Primary Examiner* — Thai Pham
(74) *Attorney, Agent, or Firm* — Schwegman Lundberg & Woessner, P.A.

(57) ABSTRACT

The present invention is directed to a method for brightness compensation in at least one light emitting diode. The proposed method achieves an always constant brightness of an LED irrespective of temperature fluctuations. The invention is further directed to a respectively configured device as well as a memory module for use in the proposed method.

10 Claims, 4 Drawing Sheets

Figure 1:
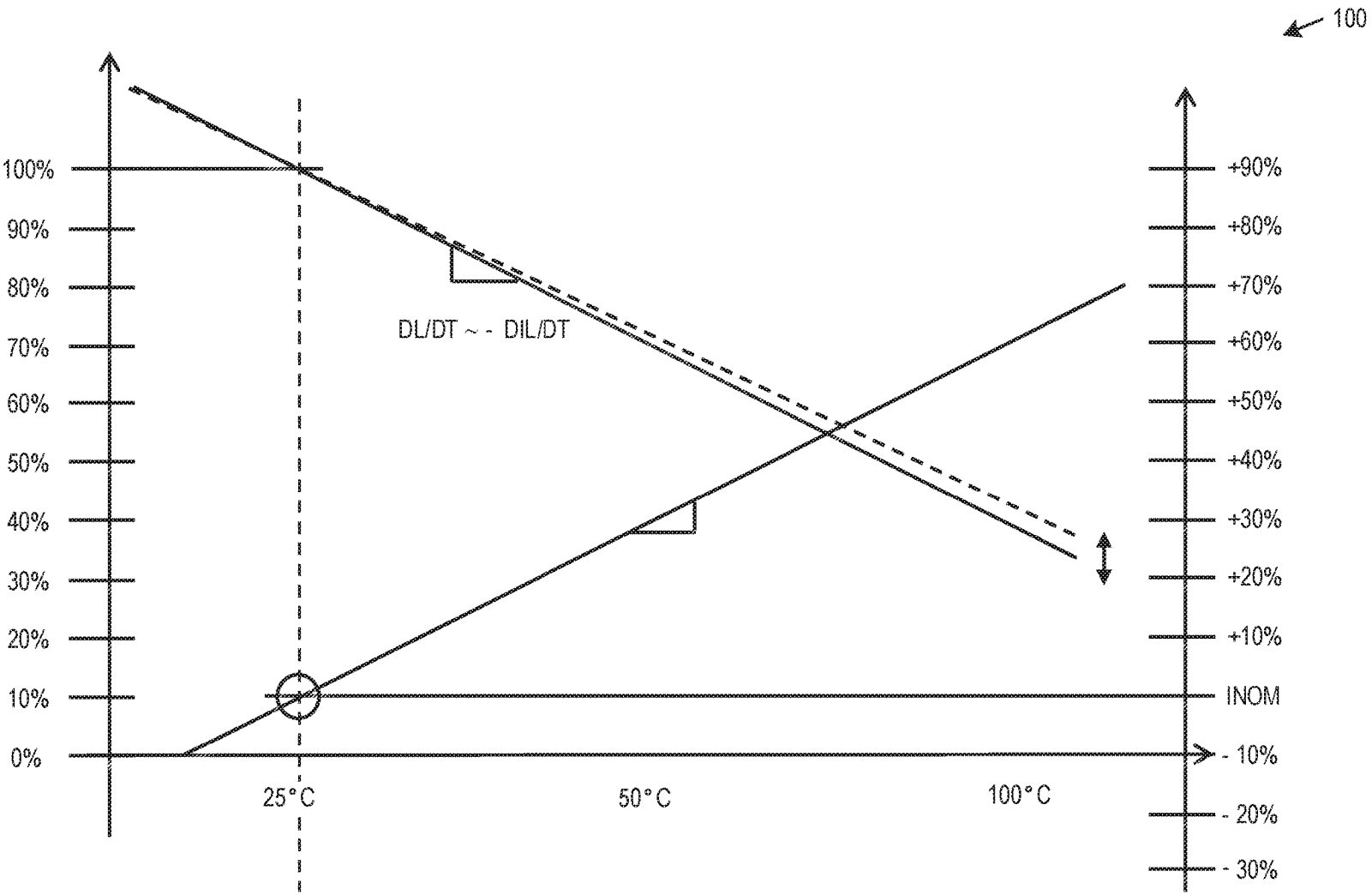

(58) Field of Classification Search
CPC ..... H05B 37/02; H05B 45/10; H05B 45/24; H05B 45/2808
See application file for complete search history.

(56) References Cited

U.S. PATENT DOCUMENTS

| | | | | |
|---|---|---|---|---|
| 2008/0215279 | A1* | 9/2008 | Salsbury ..... | H05B 33/0863 702/107 |
| 2012/0286666 | A1* | 11/2012 | Shteynberg ..... | H05B 33/0827 315/113 |
| 2012/0319585 | A1* | 12/2012 | Shteynberg ..... | H05B 33/0818 315/112 |

FOREIGN PATENT DOCUMENTS

| | | | |
|---|---|---|---|
| WO | WO-2014067830 | A1 | 5/2014 |
| WO | WO-2017153026 | A1 | 9/2017 |

OTHER PUBLICATIONS

"International Application No. PCT/EP2017/000092, International Search Report and Written Opinion dated May 8, 2017", (May 8, 2017), 11 pgs.
"International Application No. PCT/EP2017/000092, English Translation of International Preliminary Report on Patentability dated Jun. 26, 2018", (Jun. 26, 2018), 7 pgs.

* cited by examiner

METHOD AND DEVICE FOR BRIGHTNESS COMPENSATION IN AN LED

PRIORITY CLAIM TO RELATED APPLICATIONS

This application is a U.S. national stage filing under 35 U.S.C. § 371 from International Application No. PCT/EP2017/000092, filed on 26 Jan. 2017, and published as WO2017/153026 on 14 Sep. 2017, which claims the benefit under 35 U.S.C. 119 to German Application No. 10 2016 104 440.7, filed on 10 Mar. 2016, the benefit of priority of each of which is claimed herein, and which applications and publication are hereby incorporated herein by reference in their entirety.

The present invention is directed to a method for brightness compensation in at least one light-emitting diode. The proposed method achieves an always constant brightness of an LED irrespective of temperature fluctuations. The invention is further directed to a respectively configured device as well as a memory module for use in the proposed method.

US 2008/0079371 A1 shows an arrangement for color correction of a light emitting diode as a function of a measured temperature, wherein a current is calculated.

US 2012/0319585 A1 shows a further arrangement for color correction of a light emitting diode as a function of a measured temperature.

WO 2014/067830 A1 shows a method for temperature correcting controlling of light emitting diodes.

EP 2 141 965 A1 shows a method for controlling displays.

Light-emitting diodes find versatile application in different colors, sizes and designs. They are used as signal and light transmitters, for example in the "automotive sector". Typically, a light-emitting diode is supposed to constantly provide an adjusted brightness. In this connection, the decreasing luminosity with increasing temperature is a disadvantage. In the prior art, methods are known which are supposed to adjust the luminosity. Here, known methods particularly address a dimming of light-emitting diodes, while solutions for a general compensation of luminosity are disadvantageous since temperature fluctuations are typically not or only insufficiently taken into account.

Known methods provide a pulse width modulation PWM which takes advantageous of the fact that inertia of the used components exists in that a uniform brightness is reached, even if the light-emitting diode is turned on or off with a certain proportion. Then, the brightness is adjusted depending on the relation of the on-state to the off-state. Such a pulsation of the light-emitting diode is typically not recognized by the human eye, and a uniformly adjustable brightness results from such control.

Furthermore, it is possible to integrate a pulse generator into the constant current source circuit, wherein the supply voltage remains the same and the pulsing of the lamps is carried out with the power source operated in pulsed operation by itself. Therefore, control circuits are known with which the light-emitting diodes are controlled to an adjustable set value, wherein the set value is adjustable by a controller. Dimming of the light-emitting diodes is carried out according to known methods directly with dimming of the current by means of the light-emitting diodes. Further, control logics for controlling the current supply for the light-emitting diode are known, also depending on the temperature of the light-emitting diode.

Light-emitting diodes LEDs are used in several application scenarios in which they should not be disadvantageous compared to light bulbs. While light bulbs can be dimmed easily in regard to their brightness, methods are known for light-emitting diodes, which methods can control these light-emitting diodes, for example, by a predetermined control pattern and, thus, make an optical dimming possible. In contrast thereto, it is often desired to adjust a light-emitting diode to be brighter, for example, with increasing environment temperature. This is the case since LEDs typically exhibit a luminescent behavior which reduces the emitted luminosity depending on an increasing temperature value.

Furthermore, it is known to measure a certain brightness of a light-emitting diode and to carry out a re-adjusting of the light-emitting diode depending on the brightness of said light-emitting diode in a way such that the same achieves a predetermined brightness value. In order to do so, however, optical sensors are necessary. Also, methods are known which provide a logic for initiating a control of a light-emitting diode in a way such that predetermined brightness values can be achieved. Hereto, however, complex components are necessary, which result in increased technical effort and, thus, increased manufacturing costs.

Thus, it is an object of the present invention to provide a method or a device, which respectively enables a constant adjustment of a brightness of a light-emitting diode irrespective of the environment temperature. Thus, it is to be achieved to control a light-emitting diode even with decreasing brightness of said light-emitting diode due to an increased environment temperature in a way such that the desired brightness value can be re-set. Thus, light-emitting diodes are not supposed to vary in brightness depending on temperature, but should rather constantly provide the same brightness in case the light-emitting diodes heat up during their operation, or in case adjacent components emit heat. It is furthermore an object of the present invention to provide a memory module which supplies data for brightness compensation of at least one light-emitting diode.

The object is achieved by the features of the main claim. Further advantageous developments are defined in the dependent claims.

Accordingly, a method for brightness compensation of at least one light-emitting diode depending on a temperature value is proposed. The method comprises the step of measuring of a temperature value with respect to a plurality of light-emitting diodes as well as the step of readout of a current value from several current values stored in a memory module, which current value is assigned to the read-out temperature value. Further, controlling of at least one current controller of a respective light-emitting diode by means of the read-out current value is carried out.

In accordance with the present invention, brightness compensation is carried out in an efficient manner in a way such that substantially analogue components are provided, which adjust the brightness of the light-emitting diode typically independent from its color value. That way, the method according to the present invention can be combined with conventional methods in a way such that, for example, a color value is adjusted by means of pulse width modulation and, further, the brightness of the light-emitting diode is provided only by controlling the light-emitting diode based on the read-out current value. Here, in accordance with an aspect of the present invention, a constant current modulator, also referred to as constant current regulator, can be used. Furthermore, it is possible to adjust the color value of a light-emitting diode by means of an ON/OFF-modulator.

On hand, a light-emitting diode is to be understood as a means which can comprise further LED chips. Thus, the light-emitting diodes according to the present invention consist of further light-emitting diode units or semiconductor chips, respectively. Therefore, for example, the known red, green and blue light-emitting diodes can be used, which can be adjusted in regard to the so-called RBG color space. These single light-emitting diode units are combined in a housing of a light-emitting diode in a way such that the light thereof is put together to a predetermined color value. That way, it is possible, as an example, to adjust a mixing ratio in a way such that the light-emitting diode emits white light in total. Therefore, further means can be provided, such as a diffuser. With a combination of single light-emitting diodes or light-emitting diode units, an arbitrary colored light can be adjusted by means of a suitable control of the single components. Thus, even color transitions can be generated. In accordance with the present invention, for example, so-called Multi-LED components can be used.

The proposed method makes it possible to control the brightness substantially irrespective of the color setting. Thus, in accordance with the present invention, when adjusting the color value, it can be avoided to be required to provide for further bits in order to adjust the brightness of the light-emitting diode together with adjusting the color value. By means of controlling a current value of the light-emitting diode, the disadvantage of conventional methods is overcome, that, for example, a color value has to be adjusted by means of 8 bits, wherein, however, 10 bits have to be transmitted. In accordance with the present invention, this disadvantage is overcome by the fact that the bit values to be used are only used for color adjustment. For this purpose, analogue components are typically provided, which cause a control of the current controller irrespective of the preset color value based on a suitable current value.

Furthermore, a current value is provided in a particular advantageous manner by means of a readout process. This provides the advantage that no separate logic has to be provided, for example by means of digital components. According to the present invention, the logic which is used in conventional methods for providing the current value is merely implemented by a readout of a data memory. Thus, no further method steps are required, which would cause the calculation of a current value. Therefore, in accordance with the present invention, it is possible to provide a suitable current value for controlling the light-emitting diodes, based on low technical effort, i.e. by means of highly efficient components such as analogue components, and by means of only few method steps.

According to the present invention, this can be achieved by the fact that the current values which cause a certain brightness of an LED can be determined already before the processing of the method or during preparatory method steps of the method. This, however, usually only happens once and, thus, can be used for a plurality of uniform light-emitting diodes. That way, light-emitting diode compensation devices are made possible, which devices advantageously require fewer components, and particularly fewer complex components. Furthermore, the proposed method enables a stable determining of the current value in a way such that calculation errors or logical errors during determination of the current value can be prevented. Further, according to the invention, it is advantageous that the stored current values can be arbitrarily tested before delivering the respective components. That way, these current values are not generated during running time but are rather determined a priori, tested and are merely provided by means of efficient hardware.

Since LEDs typically glow less with increasing temperature, in the course of one method step, a measuring of at least one temperature value is necessary. Here, the temperature value can refer to a temperature condition of the light-emitting diode. Thus, it can be advantageous to directly measure the temperature value at the light-emitting diode. For this purpose, it is also possible to determine an ambient value of the light-emitting diode in the immediate vicinity of the light-emitting diode. Also, it can be advantageous to determine multiple temperature values and combine them to one single temperature value. Here, even temperature values of adjacent components can be determined and can be averaged after their summation. In case light-emitting diodes are connected in series, plural temperature values of one light-emitting diode, respectively, can be measured, and these values can be averaged. Even this procedure can be realized by means of analogue circuits and does not require digital components.

In a further method step, a readout of a current value from several current values stored in a memory module is carried out, which current value is assigned to the read-out temperature value. For this purpose, current values are to be determined in the course of preparatory method steps, which values cause a certain brightness depending on a temperature value. For example, it is the case that a specific light-emitting diode requires a current of 5 mA, i.e. 5 milliamps, at a temperature value of 24° C. Since the light-emitting diode glows less with increasing temperature, i.e. less bright, a current value of 10 mA can be required at a temperature of 50° C. in order to achieve the same brightness as achieved at a temperature of 24° C. by 5 mA. In case the temperature of the light-emitting diode is at 100° C., even a current value of 20 mA can be required in order to achieve the same brightness. Thus, the same light-emitting diode achieves the same brightness at 24° C. with a control drive of 5 mA as the same light-emitting diode with a control drive of 10 mA at 50° C. That way, the brightness behavior of the light-emitting diode is adjusted depending on the determined temperature value. This is particularly advantageous since the observer of the light-emitting diode always perceives the same brightness, even in case the temperature of the light-emitting diode changes during its operation.

Thus, in accordance with the present invention, a substantially uniform adjustment of the brightness of the light-emitting diode is carried out, wherein the brightness is compensated in such a way that the human eye does not perceive any difference in brightness. Thus, it can be necessary to process the method in an iterative manner in a way such that certain temperature leaps can be identified immediately, and such that the controlling current value can be newly adjusted.

Hereto, it can be possible to define a time interval which determines the length of the measurement of the temperature value at the light-emitting diode or in its vicinity. This can be adjusted, for example, depending on the used components. Also, it is possible to determine temperature intervals in a way such that a current value is assigned to certain temperature ranges, respectively. For example, it is possible to assign a current value to temperature steps of 10° C. or 20° C., respectively. For example, a current value can be assigned to a temperature interval of 60° C. to 80° C. That way, it is possible to carry out the provision of a current value in such an efficient way that the brightness of the light-emitting diode does not have to be adjusted all the time, but only when leaving the limits of a temperature interval.

A logical table can be used for storing the single current values along with its temperature values or temperature intervals. This is not restricted to the actual presence of such a table, but also any kinds of representations are possible, for example at least one pair of attribute/value, or at least one pair of value/value. It is particularly advantageous to store the single values in a way such that they can be read-out and processed in an efficient manner. That way, even hard-coded circuits or hard-wired components are usable. This is possible since no changes occur after delivering the respective components and, thus, a hard-wired provision of the respective logical table can be carried out.

Correspondingly, the memory module or the storing of the current values is to be interpreted in a way that any kind of memory module or of a storing process is possible. Thus, the memory module does not have to be dynamically configured in a way such that it has to be writeable during a running time, i.e. during the control of the current controller. A storing rather requires merely the introduction of the respective information into a hardware module in any manner. Also, it can be necessary to not only provide one single memory module but to also provide further components which enable the provision of a current value. Further, the assignment of the current values to the temperature values occurs in the course of preparatory method steps and arises implicitly with the operation of the proposed method in that one current value is already available for each measured temperature value.

In case this one current value is already read-out or has been identified, which current value is necessary for the measured temperature value for brightness compensation, a control of at least one current controller of each respective light-emitting diode is carried out based on the read-out power supply value. Thus, the brightness value of the light-emitting diode is adjusted based on the absolute value of the respective current value. The current controller is thus configured to apply the predetermined voltage to the light-emitting diode or light-emitting diode units. That way, the light-emitting diode is controlled based on the read-out current value. This procedure is carried out until a new temperature value along with a corresponding current value is determined and the light-emitting diode is controlled with this new current value. Thus, the brightness of the light-emitting diode is fixated, wherein different current values are required depending on the prevailing temperature at different points of time.

According to an aspect of the present invention, at least one sensor for measuring the temperature value at at least one measuring location is provided. Several measuring locations are suitable here, such as a measuring location at one precise light-emitting diode, a measuring location at each one light-emitting diode, a measuring location at a microcontroller connected to the light-emitting diode, or a measuring location in an immediate vicinity of the light-emitting diode. For example, the proposed method can be used with several interconnected light-emitting diodes. Here, it is possible that, for example, several light-emitting diodes are connected in series. If this plurality of light-emitting diodes is installed in an automobile, it can happen that different temperatures prevail at different sites of operation. Not only can the light-emitting diodes heat themselves up, but also an emission of heat from adjacent components can occur. That way, according to the present invention, it is possible to take this circumstance into account and to determine a temperature value at several measuring locations. Here, immediate vicinity is defined as the vicinity which allows a conclusion about the temperature of the light-emitting diode. Thus, the temperature does not have to be determined directly at the light-emitting diode, but a temperature sensor can also be spaced apart from the light-emitting diode in a way such that a temperature influence from adjacent components can be considered to be negligible. In particular, this means that no physical contact in the sense of the temperature sensor being in contact with the light-emitting diode is necessary.

According to another aspect of the present invention, the light-emitting diode is a triple of three light-emitting diode units, and each of the light-emitting diode units emits a different color. This provides the advantage that LEDs can be used, which emits colored light. In particular, in accordance with the present invention, it is possible to continue to use conventional LEDs and to merely control the current controller of these LEDs in a way such that the advantage according to the present invention presents itself. Furthermore, the proposed method provides the advantage that the brightness compensation can be carried out irrespective of the color setting of the light-emitting diode. Here, the skilled practitioner is aware of further light-emitting diodes comprising light-emitting diode units which can be re-used, according to the present invention. For example, a light-emitting diode unit can exist in the form of a semiconductor component, or in the form of any light-emitting component. An emission of different colors, i.e. light of different wavelengths, acts for the adjustment of a predetermined color value.

According to yet another aspect of the present invention, the memory module provides a plurality of temperature values to which a current value each is assigned. This provides the advantage that a plurality of temperature values can be taken into account and that the temperature values can be predetermined in regard to the current values in a way such that the same brightness value of the light-emitting diode constantly occurs. In particular, the number of pairs of current value/temperature value can be determined in a preparatory method step.

According to yet another aspect of the present invention, the read-out current value is assigned to a temperature interval into which the measured temperature value falls. This provides the advantage that, in case of a certain temperature value, the light-emitting diode does not have to be controlled immediately, but that it can be checked first if the temperature value falls within a certain interval. For example, a decrease of the temperature value does not immediately results in a visible change of the brightness value. Thus, it can be waited for a dropping of the measured temperature value below a certain threshold value which requires an adjustment of brightness. Furthermore, this provides the advantage that a highly effective method is proposed, which method can be carried out with few performant components. Accordingly, the number of single brightness compensation processes can be adjusted depending on the extent of the temperature intervals. Further, it is also possible to determine the temperature intervals in a way such that they are not equidistant to each other. Thus, a first temperature interval can comprise a first temperature range of 5° C., and a second temperature interval can comprise a second temperature range of 10° C. With the choice of the respective extents of the temperature intervals, the underlying physical components can be taken into account, and, above all, a behavior of the light-emitting diode can be taken into account.

According to yet another aspect of the present invention, a current value is selected in regard to the temperature value such that a brightness compensation of the light-emitting diode to be controlled is configured in dependence on a prevailing temperature. This provides the advantage that not only a brightness of the light-emitting diode can be adjusted, but also that a re-adjustment of brightness can be carried out over a temporal progression, respectively, such that the brightness is always compensated depending on the temperature value. This is the case since the brightness value changes depending on the temperature value and, in case a new temperature value is detected, the brightness value can again be compensated in a way such that it meets the predefined set value.

According to yet another aspect of the present invention, the current controller exists in the form of a constant current controller. This provides the advantage that known components can be re-used and that the arrangement merely must be adapted in a way such that it carries the method according to the present invention out. That way, known current controller can be used, which control the light-emitting diode based on the advantageous determined current value.

According to yet another aspect of the present invention, the temperature value is an averaged value of several measured single temperature values. This provides the advantage that several temperature values which are determined at different measuring locations can be combined in a simple manner to one single temperature value. This can be implemented, for example, by means of a hard-wired logic. According to the present invention, however, it is also possible that no logic at all is necessary. Therefore, merely a readout of the memory module is initiated, without the need that these values must be interpreted in any way. Thus, merely a simple lookup operation is carried out, without any kind of logic required.

According to yet another aspect of the present invention, the storing of several temperature values along with one current value each is carried out by means of at least one determination routine. Here, the possibilities include an empiric determination, a measuring, a two-point measurement, a calculation and a readout of the respective current values. Thus, the storing of current values along with the respective temperature values corresponds to a filling of a logic table which describes what current value must be applied at which temperature. This can be carried out in the course of preparatory method steps in a way such that a certain current value is applied to a light-emitting diode at a certain temperature and that the brightness is measured. This process is carried out in an iterative manner as often as necessary until it can be determined how the temperature or the applied voltage or the current value affects the emission of light. Thus, it can be determined empirically what current value must be applied at which temperature in order to achieve a certain brightness. Then, the pairs of attribute/value or the pairs of value/value are stored, which pairs result in a constant brightness. This includes a measuring in a way such that an applied current value is varied such that the brightness arises in dependence of the prevailing temperature. This can also be calculated in advance, which typically requires further parameters. Here, it is possible to retrieve the respective parameters from, for example, the manufacturer. Also, respective tables can be provided by the manufacturer of light-emitting diodes, which tables then only have to be read-out. Furthermore, the skilled practitioner is aware of the two-point measurement with which suitable pairs of attribute/value can be determined.

According to yet another aspect of the present invention, the several stored current values are configured in a way with regard to the respective temperature value such that they constantly effect the same brightness when controlling the light-emitting diode. This provides the advantage that the same brightness value constantly prevails, or that a substantially similar brightness value prevails, or that a brightness value prevails whose difference to a previous brightness value cannot be detected by the human eye.

According to yet another aspect of the present invention, a controlling of the at least one current controller based on the read-out current value is carried out independently of the adjustment of a color value of the light-emitting diode. This provides the advantage that known methods can be continued to be used in order to adjust the color of the light-emitting diode. In particular, for the adjustment of the color value, a certain bit value can be used, which does not have to involve further bits in order to adjust the brightness. Furthermore, this provides the advantage that, for example, 8 bit are sufficient for adjusting the color value, and that no 10 bits are required for adjusting a color value and a brightness, as is usually the case. This includes the disadvantage that the pulse width modulation would be required to generate faster slopes, and that additional bandwidth would be wasted. According to the present invention, this can be avoided by separately adjusting the color values and, independently thereof, adjusting the brightness by means of the current controller.

The present invention is also achieved by a device for brightness compensation of at least one light-emitting diode depending on a temperature value. The device comprises at least one sensor which is configured for measuring a temperature value regarding a plurality of light-emitting diodes, as well as an interface component which is configured for readout of a current value from several stored current values from a memory module, which current value is assigned to the read-out temperature value. Furthermore, a current controller is provided, which is configured for controlling at least one light-emitting diode, respectively, based on the read-out current value.

The object is also achieved by a memory module with stored current values which are each assigned to a temperature value in a way such that, when controlling a light-emitting diode with the respective current value for a prevailing temperature according to said temperature value, the light-emitting diode always glows equally bright.

Further, a storage medium is provided, including control commands for execution of a method according to one of the previously described aspects.

Thus, in particular, hardware components or a method are proposed, which make it possible to carry out brightness compensation of a light-emitting diode or also of several light-emitting diodes in a particular efficient manner. It is particularly advantageous that the device is suitable for carrying out the proposed method and, thus, adopts its features in a structural manner. Also, the method can be used for operating the device, and the memory module according to the present invention can be used in the course of the proposed method or also within the proposed device.

Figure 2:
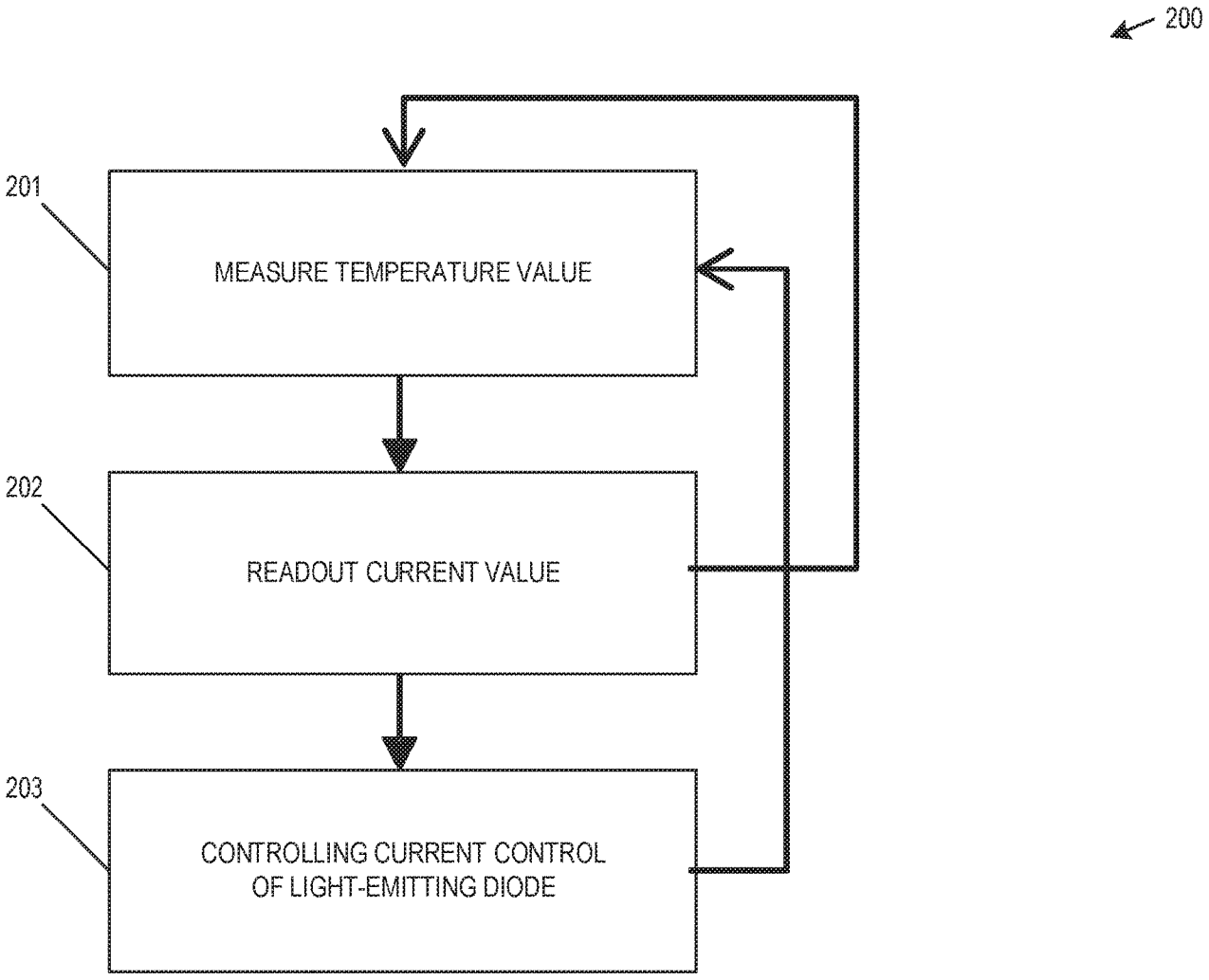
Figure 3:
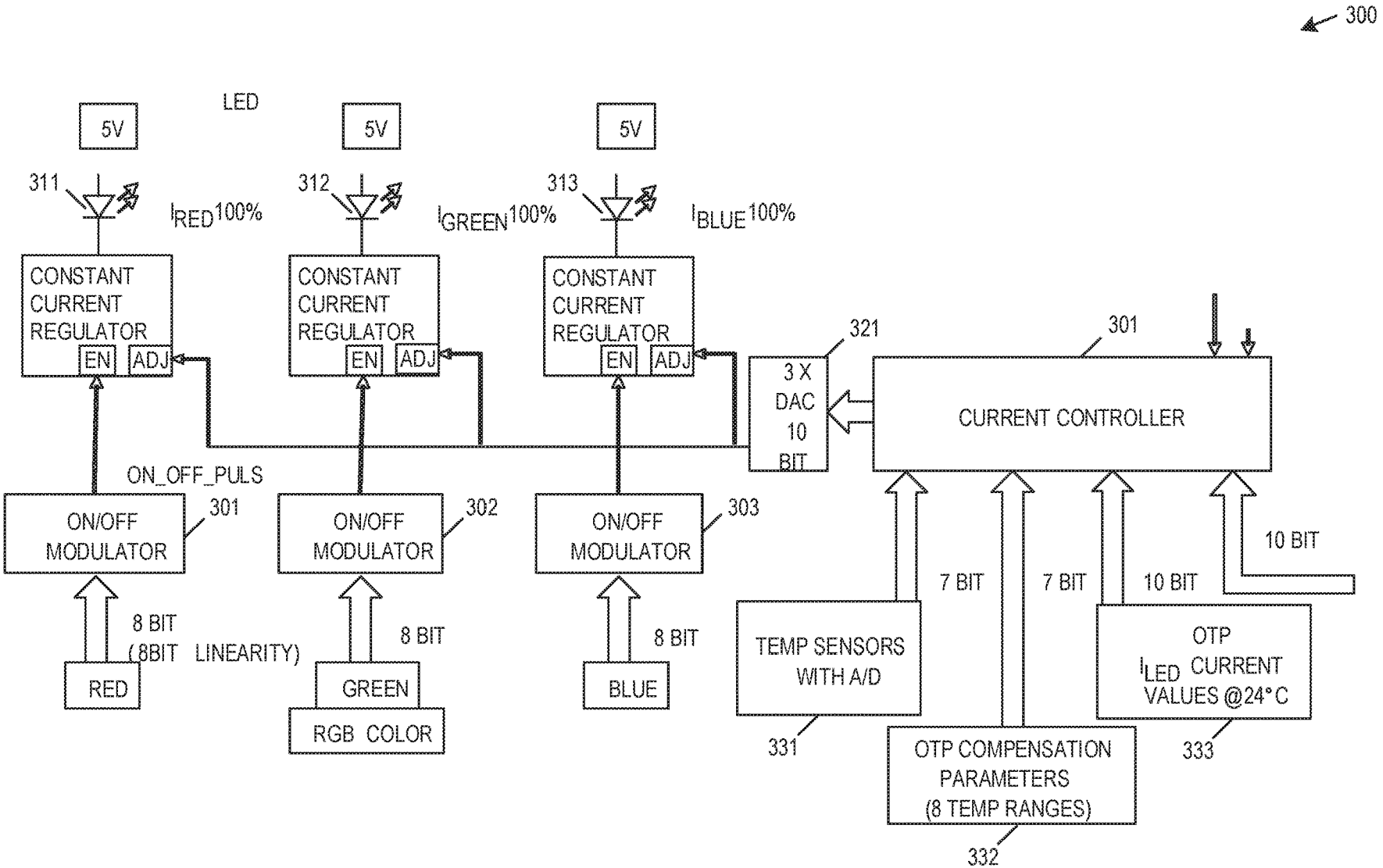
Figure 4:
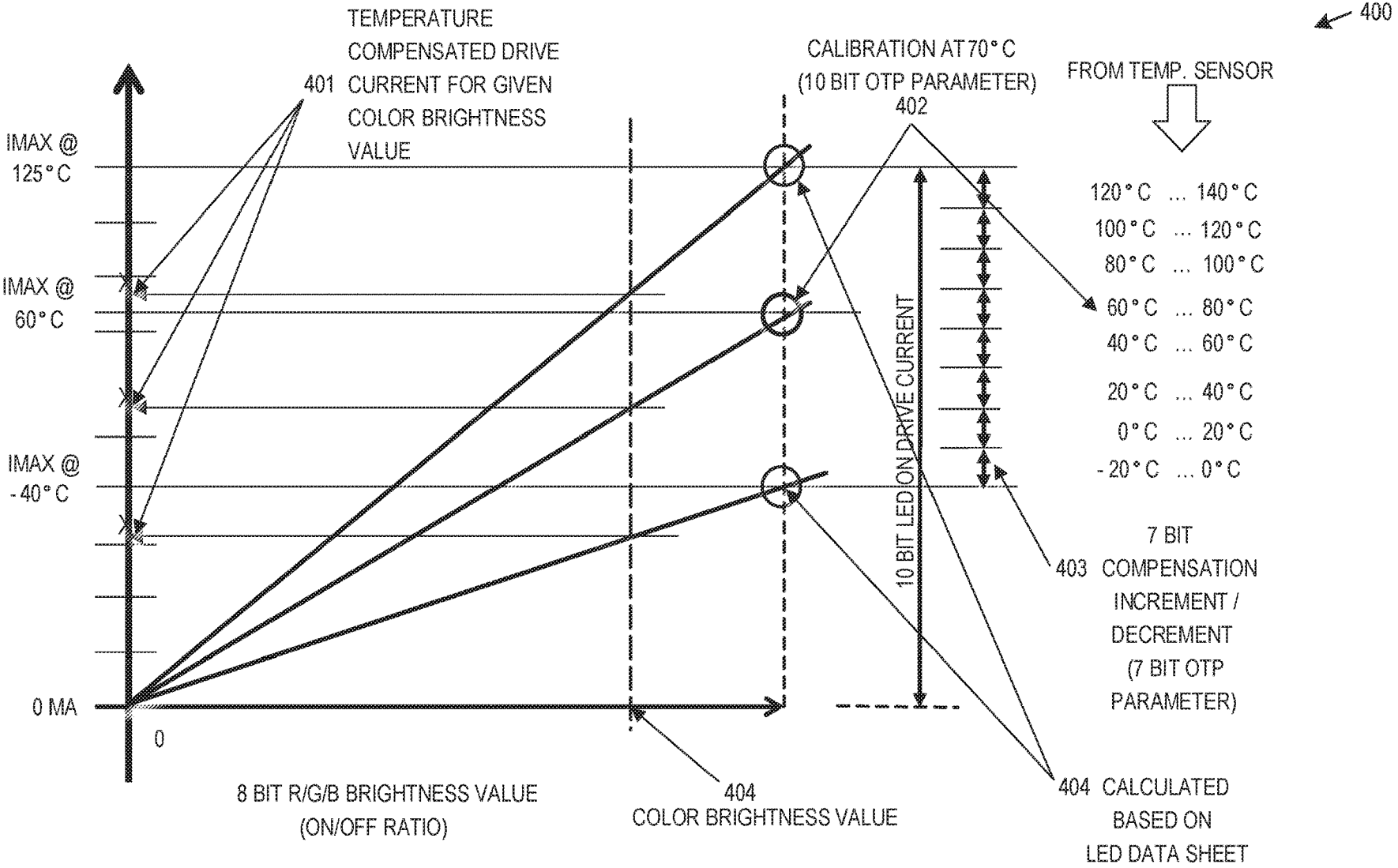

Further advantageous aspects of the present invention are described in the following based on the attached figures. It is shown in:

FIG. 1 a diagram including values which adjust brightness compensation depending on temperature values according to an aspect of the present invention;

FIG. 2 a schematic flow chart of a method for brightness compensation according to an aspect of the present invention;

FIG. 3 a device according to the present invention, for brightness compensation, with further components according to an aspect of the present invention; and FIG. 4 a storing of current values depending on temperature values according to an aspect of the present invention.

FIG. 1 shows brightness values on its y-axis, which decrease on a percentage basis from the maximum brightness of 100% to a non-glowing state of 0%. On the x-axis, temperature values are specified, which values relate to the respective light-emitting diode. Here, the course of the upper line which extends in the presently discussed FIG. 1 from the left upper side to the right lower side shows that the luminosity of the light-emitting diode decreases with increasing temperature. In contrast thereto, the lower line which extends in the presently discussed FIG. 1 from the left lower side to the right upper side shows that higher current values are necessary with increasing temperature in order to reach a certain brightness. Thus, the left scale of the y-axis relates to the upper curve, and the right scale relates to the lower curve. Here, the curve is replaced by a line. The question if the behavior is in fact linear, as shown in FIG. 1, or, contrary thereto, if actual curves are to be drawn, depends on the respective light-emitting diode. Hereto, the presently discussed FIG. 1 is merely to be understood in a schematic manner such that, with an increase in temperature, an increase in current value is also necessary in order to adjust the same brightness. Also, with the values stored in the memory module, a plurality of progressions is typically involved, wherein only one thereof is shown in the presently discussed FIG. 1 as an example.

FIG. 2 shows a schematic flow chart of the method in accordance with the present invention, wherein a measuring 201 of a temperature value is carried out with regard to a plurality of light-emitting diodes. Thereafter, a readout 202 of a current value from several current values stored in a memory module is carried out, which is assigned to the read-out temperature value. In a subsequent method step, a controlling 203 of at least one current control of each respective light-emitting diode is carried out based on the read-out current value. As can be gathered from the presently discussed FIG. 2, it is particularly advantageous to work through the method in an iterative manner in a way such that temperature values are constantly measured, and, afterwards, a current value is read-out, with which the light-emitting diode is controlled.

Furthermore, after measuring 201 of a temperature value, it is also possible to readout a current value 202 first of all, and, in case the current value has not changed, to directly branch again into method step 201. This is particularly advantageous if a temperature range is defined and if there is no need to adjust the current value after the measuring of a temperature value, in case that the temperature value lies within the temperature range from which the respective current value has already been read-out. Since the same current value is supposed to correlate within this temperature range, no new controlling of the light-emitting diode is necessary. Only if the read-out temperature value exceeds a certain threshold value, it is to be branched into method step 203 for controlling the current controller.

FIG. 3 shows the inventive device 300 for brightness compensation of at least one light-emitting diode LED. So-called ON/OFF-modulators 301-303 are provided in order to adjust a certain mixing ratio of the single light-emitting diode units 311-313. Hereto, a so-called RGB-code is provided, for which again 8 bits are provided. As can also be gathered from the presently discussed FIG. 3, the light-emitting diode units of the device 300 according to the present invention are separately controlled by current controller 301. This means that the adjusting of the color value is carried out independently from the adjusting of the brightness. Also, it can be necessary to provide further components, such as a digital/analogue-converter 321. Here, it is particularly advantageous that the device 300 does not calculate current values and does not provide a logic therefor, but that the device 300 merely checks the connected memory module and, that way, receives the respective values. Thus, the ON/OFF-modulators 301-303 operate independently from the adjustment of the current value. In particular, it is not necessary to provide the device 300 with a high-performance processor. Thus, the advantageous brightness compensation can be carried out in an efficient manner and with low technical effort.

FIG. 4 shows a schematic diagram of how current values can be provided depending on measured temperature values. This can be used in the method according to the present invention, in the device as well as in the memory module. Here, current values are specified on the y-axis 401, and brightness values are specified on the x-axis 404. That way, it is presently gatherable that each specific bit value requires a specific current value. Hereto, on the right side of the presently discussed FIG. 4, temperature intervals 403 are provided, which each require an own current value in order to achieve the preset brightness. As can be gathered from the array of lines which originate from zero point, the respective current value can be determined based on an angle which is adjusted depending on the prevailing temperature value. Here, it is particularly advantageous that the previous process can already be carried out before the execution of the method according to the present invention and, thus, the results only have to be stored.

As is evident from the presently discussed diagram, the current values have to be adjusted in a steeper way along with higher temperature values. Thus, the angle between the x-axis 404 and the array of lines is getting bigger with an increasing temperature value. Thus, a maximum current value at a maximum temperature of 125° C. can amount to 20.7 mA. With a temperature of 40° C., a current value of 4.66 mA may be sufficient. As is evident from the presently discussed, a wider compensation is necessary with increasing temperature.

Here, however, it is pointed out that this is merely one possible approach for adjusting the pair of current value/temperature value. For example, it is also possible to fill in one current value for each of the temperature intervals as specified on the right side. For example, the values specified on the y-axis 401, which values are marked with an X, are at hand three X for the temperature range 402 of 60° C. to 80° C. Such a specification in the direction of the y-axis, respectively, can be carried out depending on a brightness value of the x-axis.

This approach can be used with the method according to the present invention, as well as the device according to the present invention and the memory module. A particularly preferred embodiment of the present invention is the use of the described aspects in an automobile. Generally, the present invention is not limited thereupon, but rather the skilled practitioner recognizes several further applications in order to always provide an observer of a light-emitting diode with the same brightness.

The invention claimed is:

1. A method for brightness compensation of several light-emitting diodes (LED) depending on a temperature value, the method comprising the steps of:

measuring of the temperature value, via several sensors, with respect to a plurality of light-emitting diodes (LED), wherein several sensors are provided at several measuring locations for measuring of the temperature value and the temperature value is an averaged value of several measured single temperature values, wherein at least one sensor includes a temperature sensor, wherein at least one sensor is provided at each light-emitting diode (LED) and a time interval is defined for each light-emitting diode (LED), the time interval specifying how long the temperature value is measured at the light-emitting diode (LED);

reading out a current value from several current values stored, via an interface component, in a memory module, which current value is assigned to the measured temperature value, wherein the read-out current value is assigned to a temperature interval into which the measured temperature value falls; and controlling of at least one current controller of a respective light-emitting diode (LED) based on the read-out current value.

2. The method according to claim 1; wherein the light-emitting diode (LED) is a triple of three light-emitting diode units (LED); and wherein each of the light-emitting diode units (LED) emits a different color.

3. The method according to claim 1; wherein the memory module provides a plurality of temperature values to which a temperature value each is assigned.

4. The method according to claim 1, wherein the current value is selected in regard to the temperature value such that a brightness compensation of the light-emitting diode (LED) to be controlled is configured in dependence of a prevailing temperature.

5. The method according to claim 1, wherein the current controller exists in the form of a constant current controller.

6. The method according to claim 1, wherein the storing of several temperature values along with one current value each is carried out by means of at least one determination routine from a quantity of routines, the quantity comprising: an empiric determination, a measuring, a two-point measurement, a calculation and a readout of the respective current values.

7. The method according to claim 1, wherein the several stored current values are configured in a way with regard to the respective temperature value such that they constantly effect the same brightness when controlling the light-emitting diode (LED).

8. The method according to claim 1, wherein a controlling of the at least one current controller by means of the read-out current value is carried out independently of the adjustment of a color value of the light-emitting diode (LED).

9. A computer-readable medium having a storage medium with control commands for execution of the steps of the method according to claim 1.

10. A device for brightness compensation of several light-emitting diodes (LED) depending on a temperature value, comprising:

several sensors configured for measuring the temperature value regarding a plurality of light-emitting diodes (LED) at several measuring locations, wherein at least one sensor includes a temperature sensor, wherein the temperature value is an averaged value of several measured single temperature values, wherein at least one sensor is provided at each light-emitting diode (LED) and a time interval is defined for each light-emitting diode (LED), the time interval specifying how long the temperature value is measured at the light-emitting diode (LED);

an interface component configured for reading out a current value from several stored current values from a memory module, which current value is assigned to the measured temperature value, wherein the read-out current value is assigned to a temperature interval into which the measured temperature value falls; and a current controller configured for controlling at least one light-emitting diode (LED), respectively, based on the read-out current value.

* * * * *